US007758141B2

(12) United States Patent
Sakurai

(10) Patent No.: US 7,758,141 B2
(45) Date of Patent: Jul. 20, 2010

(54) PRINTING APPARATUS FOR SELECTIVELY DRIVING HEATERS USING A REDUCED NUMBER OF DATA SIGNAL LINES

(75) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 371 days.

(21) Appl. No.: 11/764,666

(22) Filed: Jun. 18, 2007

(65) Prior Publication Data

US 2007/0296743 A1 Dec. 27, 2007

(30) Foreign Application Priority Data

Jun. 23, 2006 (JP) ..... 2006-174139

(51) Int. Cl.
*B41J 29/38* (2006.01)
*B41J 2/205* (2006.01)
*B41J 2/21* (2006.01)

(52) U.S. Cl. ..... 347/12; 347/15; 347/43

(58) Field of Classification Search ..... 347/12
See application file for complete search history.

(56) References Cited

U.S. PATENT DOCUMENTS

| | | | | |
|---|---|---|---|---|
| 4,515,487 | A * | 5/1985 | Minami | 347/43 |
| 5,831,649 | A * | 11/1998 | Watrobski et al. | 347/19 |
| 6,290,334 | B1 | 9/2001 | Ishinaga | |
| 2004/0201637 | A1 * | 10/2004 | Kyoshima | 347/9 |
| 2005/0140703 | A1 * | 6/2005 | Ou et al. | 347/5 |
| 2005/0237354 | A1 * | 10/2005 | Quintana | 347/12 |

* cited by examiner

*Primary Examiner*—Matthew Luu
*Assistant Examiner*—Shelby Fidler
(74) *Attorney, Agent, or Firm*—Canon USA Inc IP Div

(57) ABSTRACT

A discrimination circuit is provided for discriminating between acceptance and non-acceptance of image data transmitted to a device substrate for every group of recording elements. Thereby, data corresponding to a plurality of recording element groups can be received from a common terminal.

5 Claims, 14 Drawing Sheets

PRINTING APPARATUS FOR SELECTIVELY DRIVING HEATERS USING A REDUCED NUMBER OF DATA SIGNAL LINES

BACKGROUND OF THE INVENTION

1. Field of the Invention

The present invention relates to a recording head for recording images with a recording element according to received data, and a device substrate for the recording head. In particular, it relates to an inkjet recording head having an electrothermal transducer generating thermal energy for ejecting ink and a drive circuit for driving the transducer, which are formed on a common substrate, and an inkjet recording apparatus including the inkjet recording head.

2. Description of the Related Art

The electrothermal transducer (heater) and its drive circuit mounted on an inkjet-type recording apparatus as a discharge energy generating element of the recording head are generally formed on the same substrate by a semiconductor process technique, as disclosed in U.S. Pat. No. 6,290,334, for example.

Recent inkjet recording apparatuses have a tendency to provide multi-color and multi-array nozzles on the head for improving the recording quality and speed.

For instance, a configuration that has been widely used is a black-ink ejection device substrate for recording text and a color-ink ejection device substrate for recording a picture and a diagram are mounted on one recording apparatus.

For another example, a recording apparatus has been widely used for achieving multi-color recording, such as 6-color or 8-color recording, and for extending a color space and improving the gradation of recorded images.

These features of recent recording apparatuses include the progress toward higher performance in recording quality and speed by mounting a recording head having a plurality of nozzle arrays.

FIG. 1 is a schematic view showing a layout of circuit blocks of a semiconductor substrate 100 (device substrate) for such an inkjet recording head and ink supply ports.

On the semiconductor substrate shown in FIG. 1, ink supply ports 101 are aligned in six lines for supplying ink.

From these ink supply ports 101, inks are supplied to the respective nozzle arrays so that the speeding up of the recording, the extension of the color space, and the improvement of the gradation are achieved in multiple colors.

In FIG. 1, the configuration within a circuit block 105 composed of drive circuits driving heater arrays and heaters is shown only for one on the left side of the ink supply ports 101, for convenience sake, so that those of five other ports are omitted. In the drive circuit block 105, heater arrays 102, each composed of a plurality of heaters arranged in a line, oppose each other with the ink supply port 101 therebetween. Also, drive circuits 103 for selectively driving individual heaters of the heater array 102 are arranged to correspond to the respective heater arrays 102. The heater array 102 and the drive circuit 103 constitute one array circuit 106. Pads 104 are arranged at end portions of the semiconductor substrate for applying power and signals to these heater and circuit blocks.

FIG. 2 schematically shows the circuit diagram and the flow of signals in the drive circuit 103 shown in FIG. 1.

Signals including time-sharing data for driving the heaters shared by time via the pads 104 as input terminals and image data are supplied to a block selection circuit 204 and a time-sharing selection circuit 205, which constitute the drive circuit, via an input circuit 202. In this example, input data is in a serial data form, and the data in the serial data form is converted into a parallel fashion with a shift register in the block selection circuit 204 or the time-sharing selection circuit 205. The image data converted into the parallel fashion is fed to a plurality of heater drive blocks 206 provided via latches through a signal conductor line.

The block selection circuit 204 has a function to select between enabling the heater drive blocks 1 to 8 (206) to be driven and not enabling (to be effective or ineffective) based on the image data. In this example, the eight heater drive blocks 206 are arranged. Part of data is fed to the shift register in the time-sharing selection circuit 205 arranged adjacent thereto. A decoder in the time-sharing selection circuit 205 has a function to output a time-sharing selection signal that sequentially switches the heater that can be driven in the heater drive block 206 by receiving the signal from the shift register.

The block selection circuit 204 and the time-sharing selection circuit 205 constitute a selection signal output circuit 203, and the heater to be driven is selected by the respective output signals. Also, the heater drive blocks 1 to 8 constitute the heater drive block array 206.

FIG. 3 shows the circuit diagram within the heater drive block and a heater array 306.

The heater drive block 206 includes MOS transistors for driving a heater 305 arranged to correspond to the heater, and heater selection circuits (AND gates) 307. The MOS transistor for driving a heater 305 has a function to switch the turning on electricity in the heater (switching transistor). A block selection circuit signal 302 and a time-sharing signal line 303 are inputted into the AND gates 307 (heater selection circuits), so that when both the two signals become active, the output of the AND gates 307 becomes active.

The block selection circuit signal 302 is an output signal from the block selection circuit 204, and the time-sharing signal line 303 is an output signal from the time-sharing selection circuit 205.

An output signal of the AND gates 307 converts the voltage amplitude of its signal into a power supply voltage (second power supply voltage) higher than a drive voltage (first power supply voltage) used from the input circuit to the heater selection circuit 307 with a level conversion circuit 304 (level conversion). The level-converted signal is applied to the gates of the switching transistors 305. Then, electric current flows through the heater array 306 connected to the switching transistors having the voltage applied across their gates from + toward − of heater power supply wiring 301.

The level conversion from the first power supply voltage into the second voltage level is for reducing the resistance of the switching transistor 305 by increasing the voltage applied to its gate so as to enable the electric current to flow through the heater with high efficiency.

FIG. 4 is a circuit block diagram showing the electrical relationship between the shift register 204 receiving image data and a decoder 205 for driving the heaters by dividing them in a predetermined unit time (time-sharing) as a time-sharing selection circuit.

FIG. 5 is a timing chart when image data is transmitted.

In the drawing, there are shown the heater arrays, each having 128 heaters, and eight heater drive blocks, each being 16 time-sharing driving blocks capable of driving eight heaters simultaneously.

The block selection circuit needs to receive 8-bit image data (the number of blocks) for turning on/off the heater drive block from the exterior. The image data is received by eight 1-bit S/R circuits 401 and eight 1-bit latch circuits 402 constituting the block selection circuit 204. The time-sharing selection circuit is composed of the four 1-bit S/R circuits 401 and the four 1-bit latch circuits 402 for receiving the image data and serially transmitted time-sharing data. The circuit is configured, so that these shift resisters are connected in series and images are sequentially transmitted by applying a clock signal (Clock), a data signal (Data), and a latch signal (Latch) so as to convert the serial signal into a parallel fashion. The image data converted into the parallel fashion is outputted from the eight latch circuits 402 constituting the block selection circuit and is individually supplied to the eight heater drive blocks 205. On the other hand, four output signals from the 1-bit latch circuit of the time-sharing selection circuit 205 are inputted into a decoder 403. The decoder 403 has four inputs and 16 outputs, and it selects an arbitrary 1-bit output among 16-bit outputs in accordance with the inputted data. The selected time sharing signal 303 is supplied to the heater drive blocks 1 to 8 in common.

The timing chart of FIG. 5 shows an example in that when one time-sharing data is transmitted.

The data is sequentially transmitted to the 8-bit block selection circuit 204 and the 4-bit time sharing selection circuit 205, which are 12-bit S/R in total, simultaneously with the rising edge of the clock signal. The data is fed to the latch circuit 402 provided at a position where the latch signal is changed from Hi to Low every 1-bit S/R, and the image data read when the latch signal is changed from Low to Hi is maintained. The latch circuit 402 herein is active at Low.

As described above, the recent recording apparatus has a tendency to provide a plurality of arrays of the recording elements on the head corresponding to multiple colors for improving recording quality and the recording speed.

To the head with a plurality of recording element arrays, data (image data and time sharing drive data) being equivalent to the number of the recording element arrays has been inputted. These data are supplied from a printer body. The recording head needs to have data input pads being equivalent to the number of the recording element arrays. In the configuration shown in FIG. 1 and having the six ink supply ports 101 and twelve nozzle arrays, twelve data input pads (data input terminals) are generally provided for data transmission.

FIG. 6 schematically shows the relationship between each array circuit 106 of the inkjet head, the inputted data signal, the clock signal, and the latch signal.

The 12 array circuits are arranged to have six pairs, each opposing each other with the one ink supply port 101 therebetween.

The array circuit, as shown in the drawing, is composed of the selection signal output circuit (shift register and decoder) and the heater drive block array.

The signal applied to the pad is fed to each array circuit via the input circuit. The latch signal and the clock signal are commonly applied to each array circuit. The image data signal is inputted by the clock to the shift register, which constitutes the block selection circuit through the pad individually provided in each array circuit, via the input circuit. In each array circuit, the individual data signals are applied simultaneously with the common clock signal so as to selectively drive an arbitrary heater every arrays.

Since especially in the inkjet recording head, the ink supply port needs to be provided on the substrate having circuits formed thereon, the arrangement of the heaters and their peripheral circuits is limited by the ink supply port. The ink supply port is formed of a through hole penetrating the substrate from the top to the bottom, so that a circuit and wiring cannot be formed at the position of the ink supply port. Hence, the array circuits are arranged in regions sandwiched between the ink supply ports, so that the array circuit is electrically independent from each other.

Therefore, the data signal for selectively driving an arbitrary heater for each array is individually applied, so that with increasing number of arrays, the number of lines of the data signal for feeding to the head from the apparatus body is increased.

The increase in the number of lines of the data signal causes adverse effects such as cost up of the printer body for producing the signal and a tendency for increasing the sizes of the head and the carriage.

SUMMARY OF THE INVENTION

The present invention is directed to an inkjet recording head. According to an aspect of the present invention, a recording head includes combinations of a group of recording elements for recording and a drive circuit configured to drive the recording elements of the group. The recording head also includes an input terminal configured to input data for driving the recording element; a wiring configured to commonly supply the data inputted in the input terminal to the drive circuits corresponding to of the combinations of groups of the recording elements; and a plurality of discrimination circuits provided in each of the plurality of the drive circuits and configured to discriminate between acceptance and non-acceptance of the supplied data.

Further features of the present invention will become apparent from the following description of exemplary embodiments with reference to the attached drawings.

DESCRIPTION OF THE EMBODIMENTS

Embodiments of the present invention will be described in detail with reference to the attached drawings.

The term "device substrate" does not designate merely a substrate made of a silicon semiconductor but designates a substrate having devices and wiring formed thereon.

The term "on the device substrate" does not designate simply on the surface of the device substrate but also designates inside the substrate close to the top surface. Also, the term "building in product" does not designate simply arranging separating elements on the substrate but also designates integrally forming the devices on the heater substrate by the manufacturing process of the semiconductor circuit.

The term "recording element" in the inkjet recording system designates the structure including a discharge energy generating element for generating ink ejecting energy, nozzles, and a flow path; in the thermal recording system such as a sublimation system, the term designates the heater itself.

First Embodiment

Figure 7:
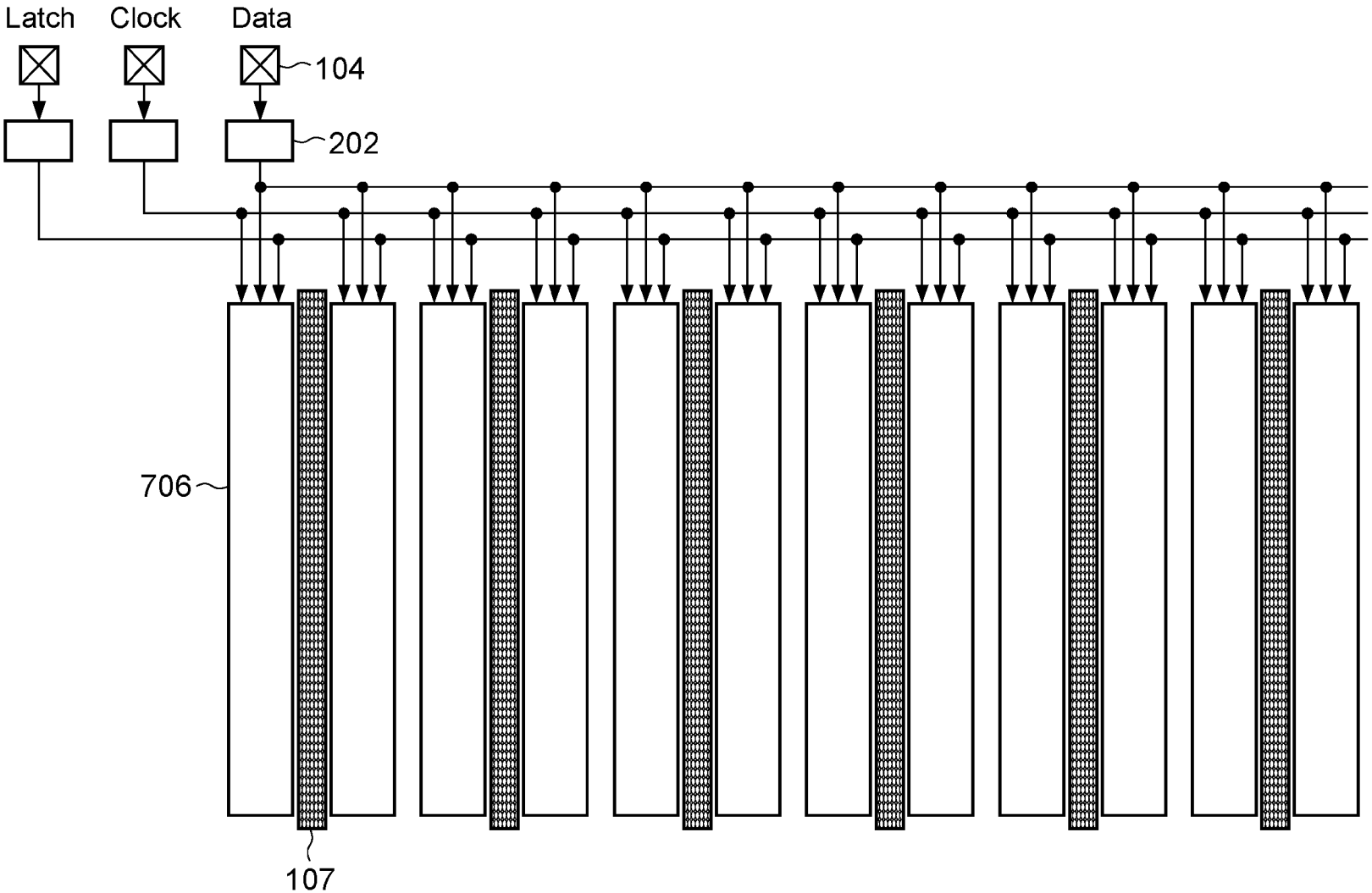
FIG. 7 is a schematic view showing a circuit block diagram and the flow of electrical signals.

FIG. 7 is a drawing schematically showing ink supply ports provided on a device substrate, a circuit block diagram illustrating a circuit built in product on the device substrate according to a first embodiment, and the flow of an electrical signal.

In the drawing, supply paths of data, a clock signal, and a latch signal to array circuits are schematically shown.

Figure 1:
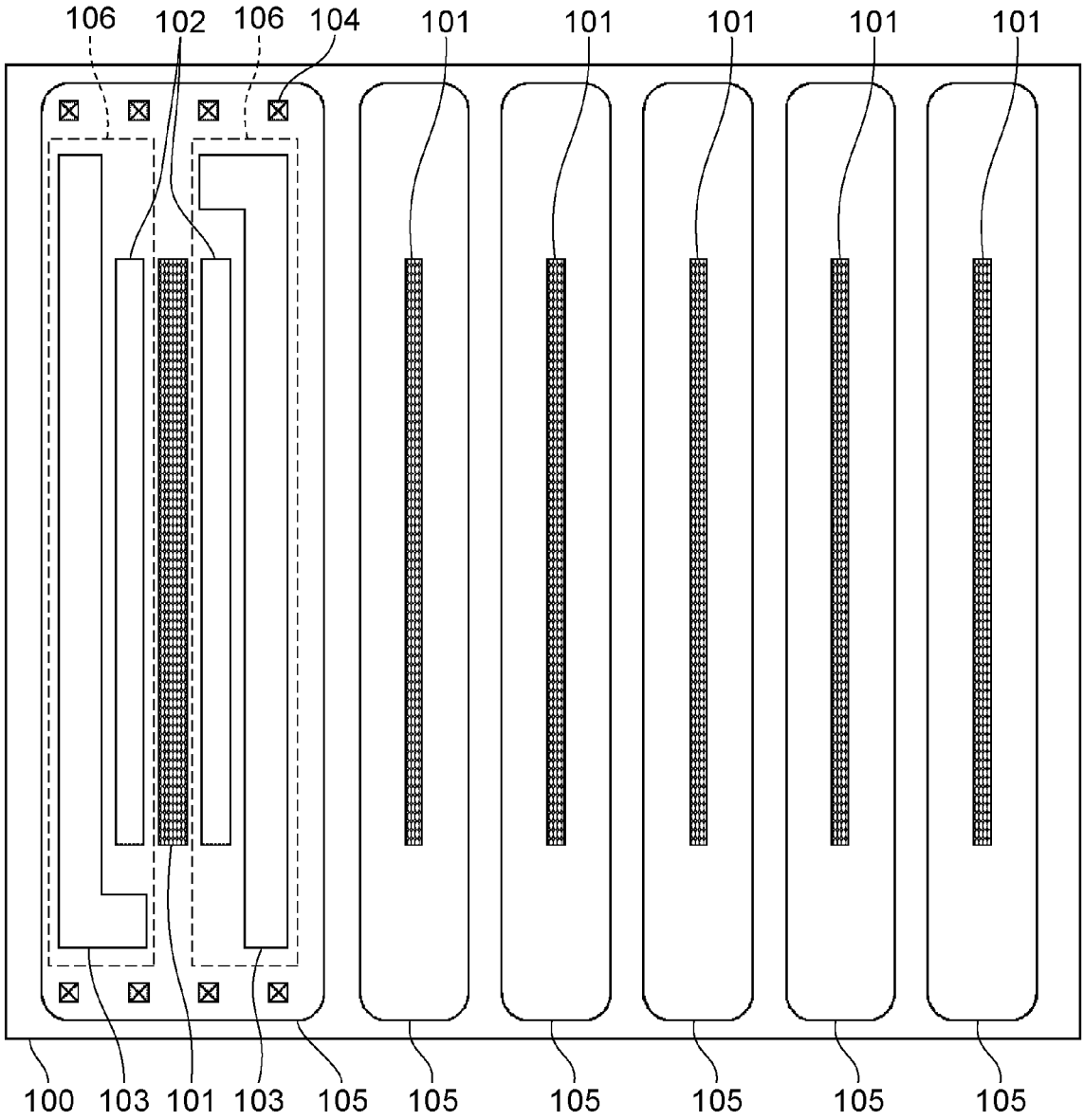
PRIOR ART FIG. 1
FIG. 1 is a schematic view showing the arrangement of circuit blocks and ink supply ports on a device substrate.

In an entitative arrangement, 12 array circuits 706 are arranged to have 6 pairs, each opposing each other with one ink supply port 107 therebetween. The array circuit 706 includes the drive circuit 103 (the shift register and the decoder, etc.) and the heater array 102, which are shown in FIG. 1, and further a discrimination circuit which will be described later.

According to the embodiment, a case is exemplified in that the heaters and the drive circuits are serially arranged due to the shape of the ink supply port. However, the invention is not limited to this case, so that any arrangement other than the serial groups may be incorporated in the invention as long as the drive circuits gather in a plurality of groups due to the shape of the ink supply port and the configuration limiting the circuit arrangement on the device substrate.

A signal applied to a pad is supplied to each array via an input circuit, such as a buffer, and wiring. As for the latch signal and the clock signal, the same signal is applied to their respective array circuits. That is, a latch signal line is commonly connected to latches of a plurality of the array circuits, and a clock signal line is also commonly connected to shift registers of a plurality of the array circuits. According to the embodiment, image data, in the same way as in the clock and latch signals, is commonly applied to shift registers of a plurality of the array circuits via one pad and one input circuit.

Figure 8:
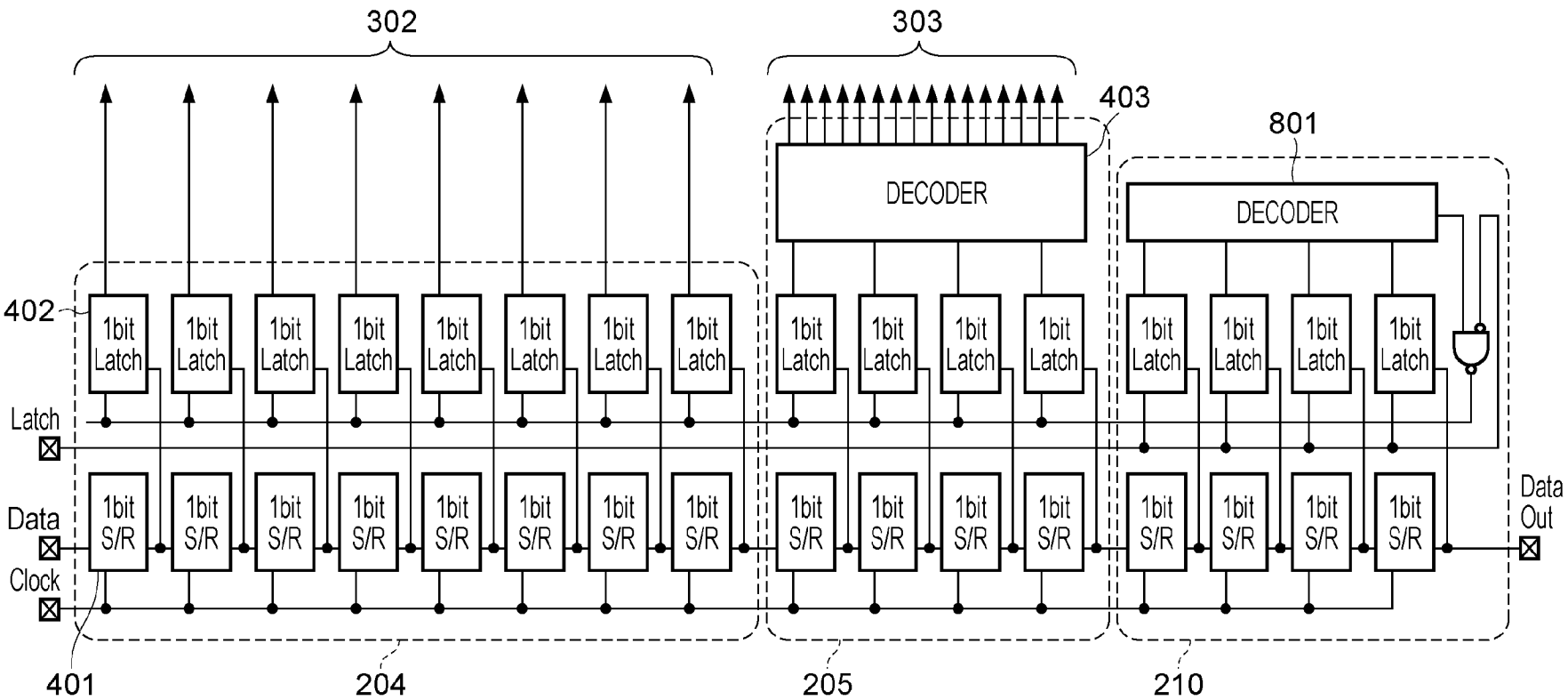
FIG. 8 is a circuit block diagram showing the electrical connecting relationship between the shift register and the decoder.

FIG. 8 shows the specific configuration of the drive circuits within one array circuit 706 according to the embodiment. FIG. 8 is a circuit block diagram including a shift register 401, a decoder 403, and a discrimination circuit 210, and shows the electrical connecting relationship between these elements. The configuration from the circuits of FIG. 8 to the heaters constituting the recording element is the same as that described in FIG. 3, so that the description herein is omitted. The shift register and the time sharing decoder have the same functions as those described in FIG. 4. The discrimination circuit 210 is configured to have a decoder 801, from which only one signal (discrimination signal) is outputted, as will be described later.

Figure 9:
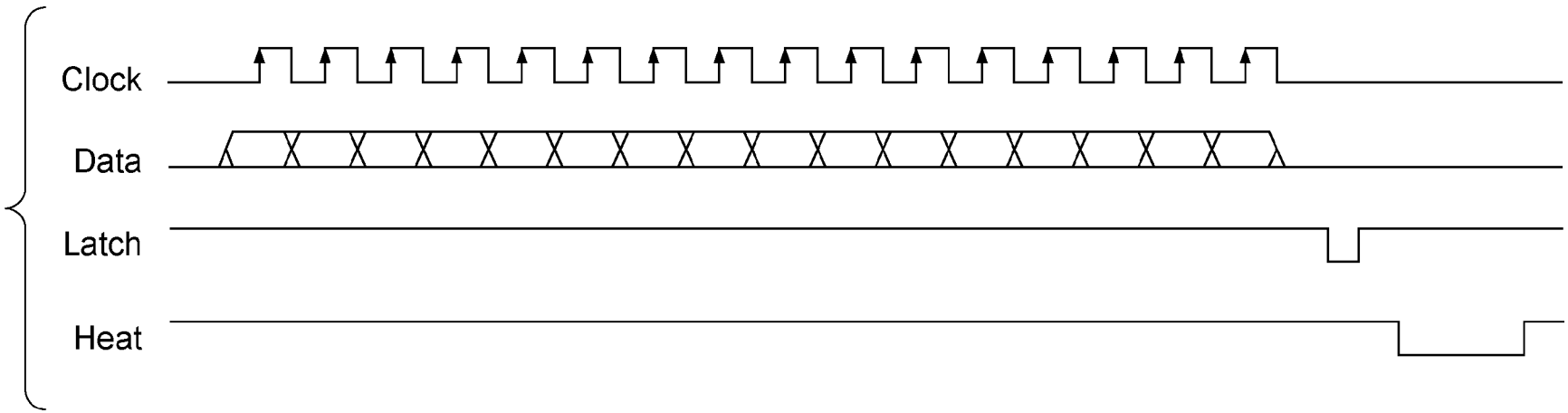
FIG. 9 is a timing chart of one time-sharing system when the image data signal in FIG. 8 is transmitted.

FIG. 9 is a timing chart for extracted one time-sharing system when the data in the circuits of FIG. 8 is transmitted.

The circuits of FIG. 8 are arranged every nozzle array.

Figure 6:
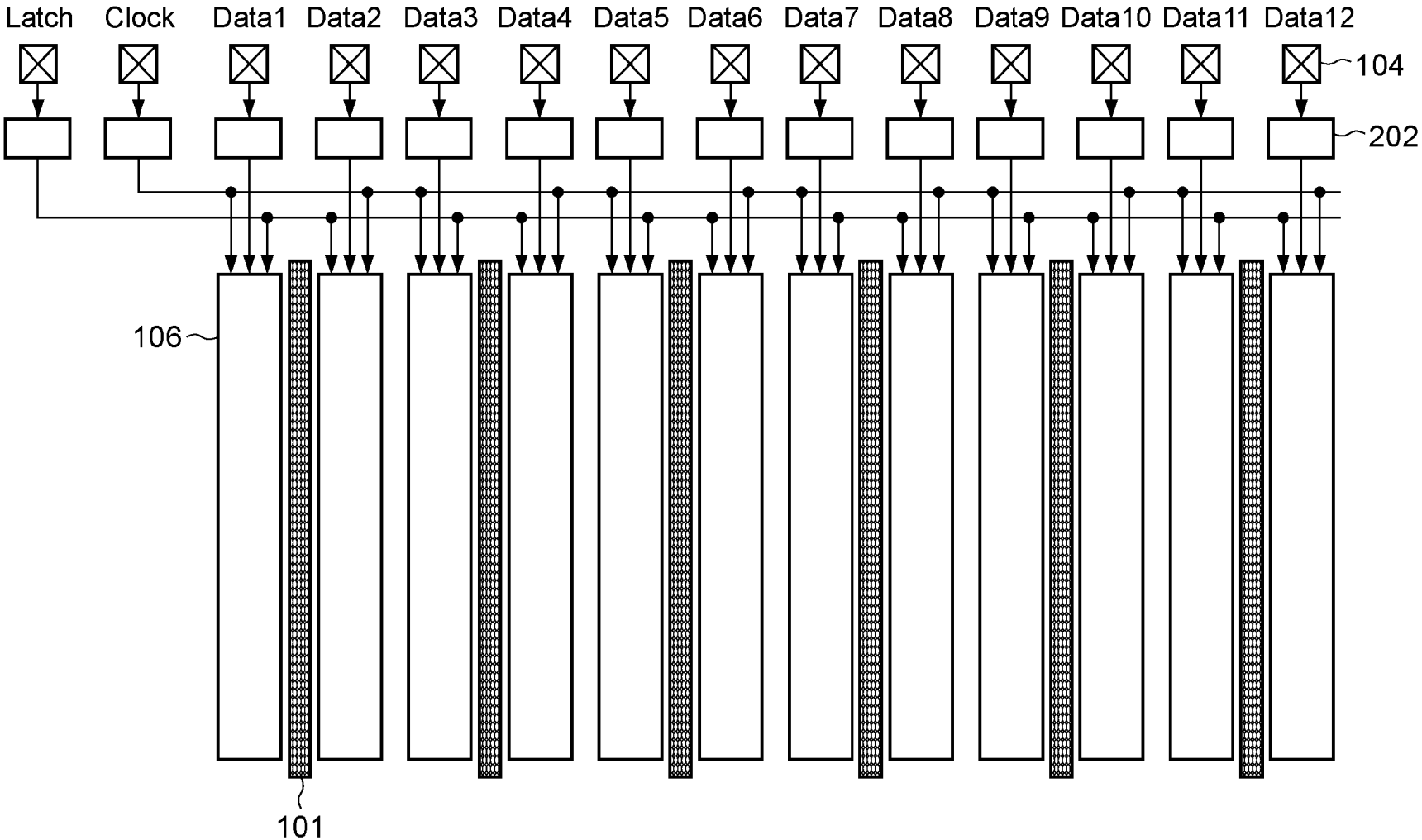
FIG. 6 PRIOR ART
FIG. 6 is a schematic view showing the relationship between each array circuit, the inputted data, a clock signal, and a latch signal.

In a related art configuration, the clock signal (Clock) and the latch signal (Latch) are commonly applied to the entire 12 arrays, while the data (Data) is individually applied to each array (FIG. 6). Whereas, according to the embodiment (FIGS. 7 and 8), the data, the clock signal, and the latch signal are commonly applied to the 12 entire arrays.

Figure 2:
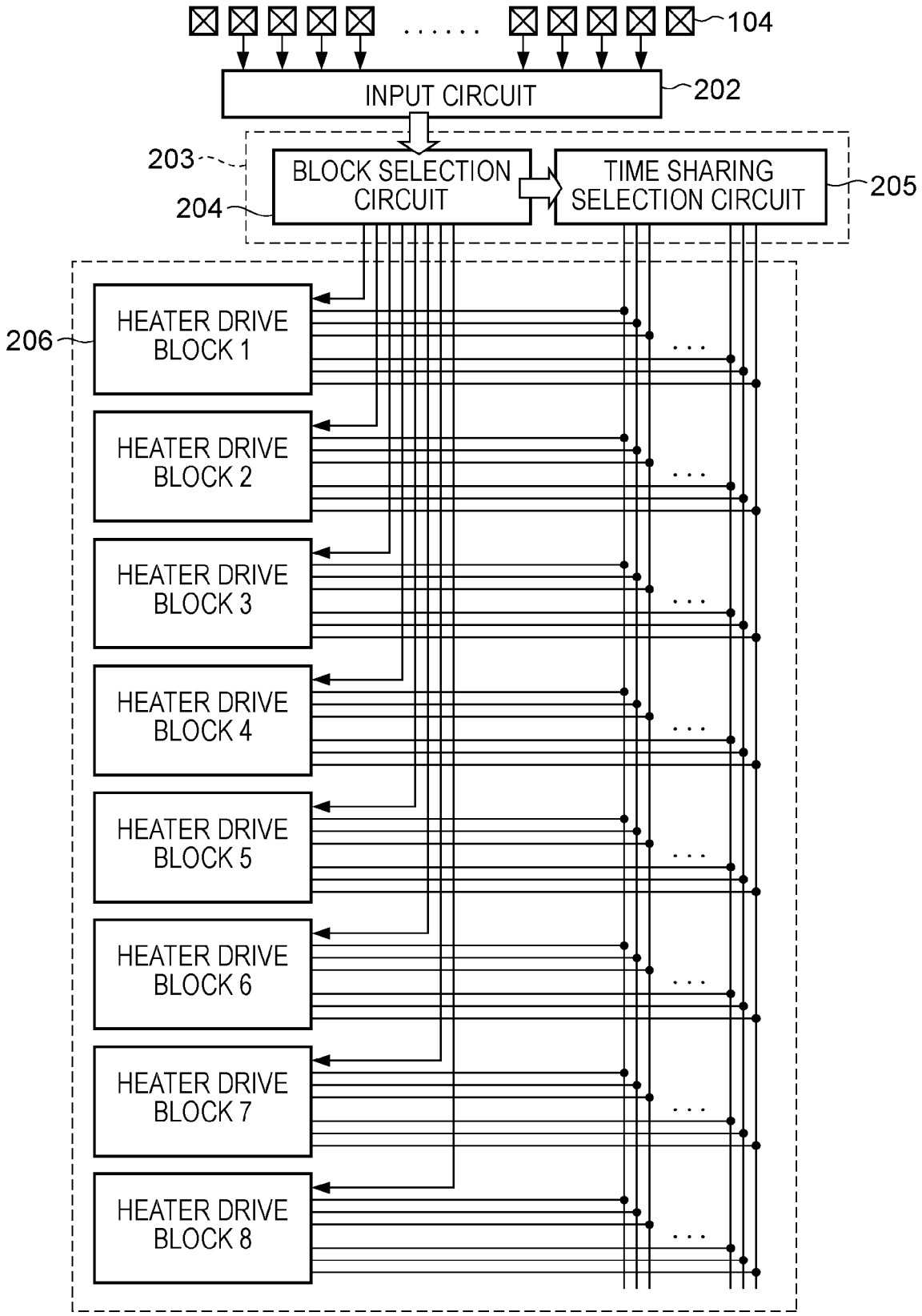
FIG. 2 PRIOR ART
FIG. 2 is a schematic view showing the circuit configuration and a signal flow of a drive circuit 103.

In these drawings, in the same way as in the block unit of FIG. 2, there are shown the heater arrays, each having 128 heaters, and eight heater drive blocks, each being 16 time-sharing driving blocks capable of driving eight heaters simultaneously.

The block selection circuit receives 8-bit image data (the number of blocks) for turning on/off the heater drive block from the exterior. The image data is received by eight 1-bit S/R circuits 401 and eight 1-bit latch circuits 402 constituting the block selection circuit 204. The time-sharing selection circuit, which drives a plurality of heaters within one block by selecting them at a plurality of different points of time, is composed of the four 1-bit S/R circuits 401 and the four 1-bit latch circuits 402 for receiving the image data and serially transmitted time-sharing data. The circuit is configured, such that these shift resisters are connected in series and images are sequentially transmitted by applying the clock signal, the data signal, and the latch signal so as to convert the serial signal into a parallel fashion. The image data converted into the parallel fashion is outputted from the eight latch circuits 402 constituting the block selection circuit and is individually supplied to the eight heater drive blocks 205 (see FIG. 2). On the other hand, four output signals (time-sharing signals) from the 1-bit latch circuit of the time-sharing selection circuit 205 are inputted into the decoder 403. The decoder 403 has four inputs and 16 outputs, and it selects an arbitrary 1-bit output among 16-bit outputs in accordance with the inputted data. The selection time-sharing signal 303 is supplied to the heater drive blocks 1 to 8 in common.

Figure 3:
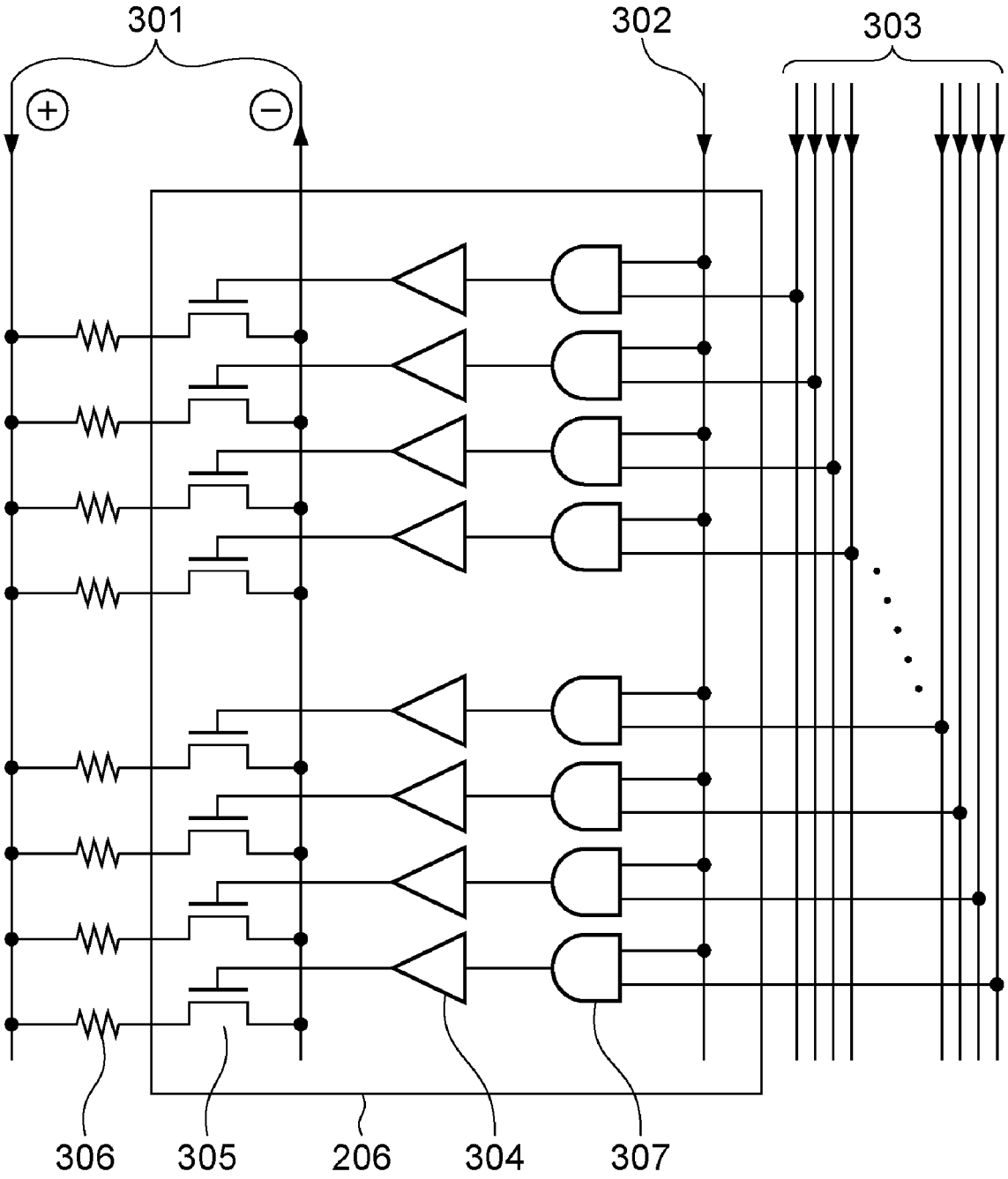
PRIOR ART FIG. 3
FIG. 3 is a drawing illustrating circuits within a heater drive block.
Figure 4:
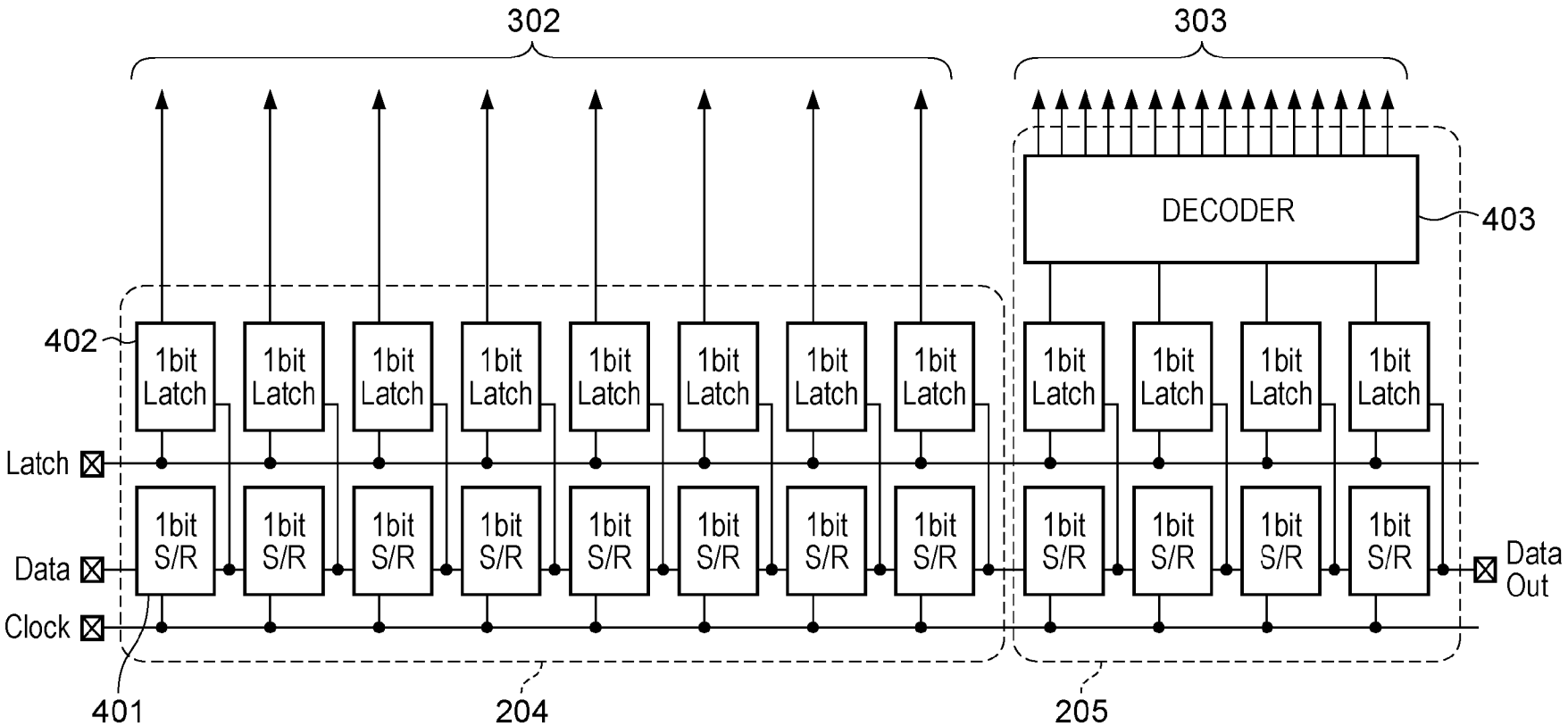
FIG. 4 PRIOR ART
FIG. 4 is a circuit block diagram showing the electrical connecting relationship between a shift register 204 and a decoder 205.
Figure 5:
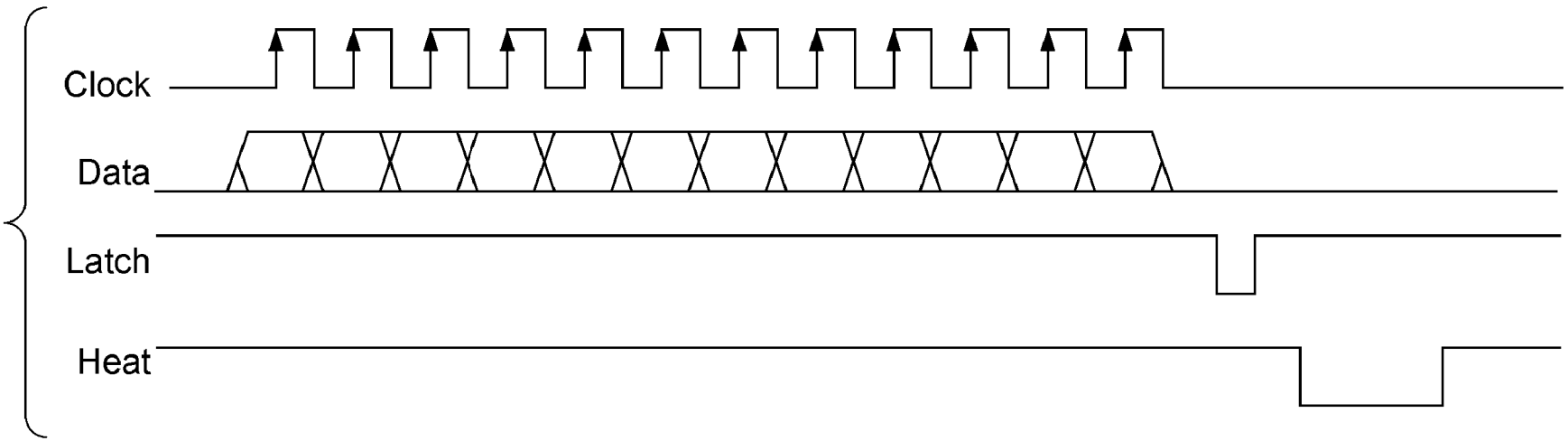
PRIOR ART FIG. 5
FIG. 5 is a timing chart when one time-sharing image data is transmitted.

As described above, the data configuration based on the image data and the time-sharing data is the same as that described with reference to FIGS. 2 to 4; however, the features of the invention further include the discrimination circuit 210, so that in addition to the block selection signal and the time-sharing selection signal, according to the present invention, a discrimination signal is outputted based on discrimination data.

According to the embodiment, 4-bit discrimination data is transmitted from the apparatus body ahead of the time-sharing data and the image data; however, the discrimination data may also be received after the time-sharing data and the image data.

The 4-bit discrimination data is for showing that the image data received from the apparatus body and the time-sharing data correspond to which array circuit in the 12 array circuits. The 4-bit discrimination data enters 4-bit shift register from outside of the head so as to be retained by a latch 402 simultaneously with the latch signal. A decoder 801 receives latched discrimination data so as to output a discrimination signal.

A discrimination circuit 210 according to the embodiment for reading and outputting discrimination data is different in each of the 12-array array circuits, so that the discrimination circuit outputs a signal only when a specific discrimination data is inputted. For example, a decoder 801 constituting the discrimination circuit can output 16-bit information by the 4-bit input by nature; however, the wiring is only for the 1-bit in the 16-bit data, so that only the 1-bit signal can be outputted outside.

When 4-bit discrimination data corresponding to a specific array is fed, a value outputted from a specific decoder of the discrimination circuit simultaneously with a latch signal becomes true.

The theoretical product of the decoder output of the discrimination circuit (discrimination signal) multiplied by the latch signal is supplied to each latch circuit of the block selection circuit and the time-sharing selection circuit as an output signal of the discrimination circuit 210.

According to the embodiment, when the output signal of the discrimination circuit is true, the output signal is supplied to each latch circuit as the latch signal of the block selection circuit and the time-sharing selection circuit. If the output signal of the discrimination circuit is false, the data is not retained by the latch in the block selection circuit and the time-sharing selection circuit.

The latch signal herein is negative logic while the output of the decoder is positive logic.

According to the embodiment, by repeating this operation twelve times so as to have a data input terminal in common corresponding to each array circuit, the data can be transmitted to all the array circuits.

The image data needs to be sequentially transmitted for each array, so that it may be necessary to increase the transmitting speed of the image data. In such a case, it is desirable to transmit the data at high speed with a differential signal having low amplitude.

As described above, distinguishing the supplied data from that to be received by each array circuit with the discrimination data enables each array to receive the data electrically independently, achieving the reduction in the number of signals.

Furthermore, a circuit may be configured in that the same data can be received by a plurality of arrays according to another embodiment.

That is, the above-mentioned discrimination circuit outputs a signal that can receive data every arbitrary one array; whereas, the same data may be received by a plurality of arrays. When the discrimination data is fed, a true signal is outputted from the corresponding discrimination circuit with a plurality of arrays so that the same transmitted data is supplied to latches of different arrays.

For example, when a high-density part of images is recorded, ink may be simultaneously ejected from nozzles of a plurality of arrays using the same image data. At this time, the image data is not individually inputted into each array but the data can be transmitted to a plurality of arrays at one time by applying information corresponding to a plurality of arrays to the discrimination circuit.

For such discrimination information corresponding to a plurality of arrays, a code selecting adjoining two arrays and a code selecting the entire arrays may be used. In such a manner, by establishing to simultaneously input data to the plurality of arrays by the discrimination information corresponding to the plurality of arrays, image data can be effectively transmitted.

Second Embodiment

Figure 10:
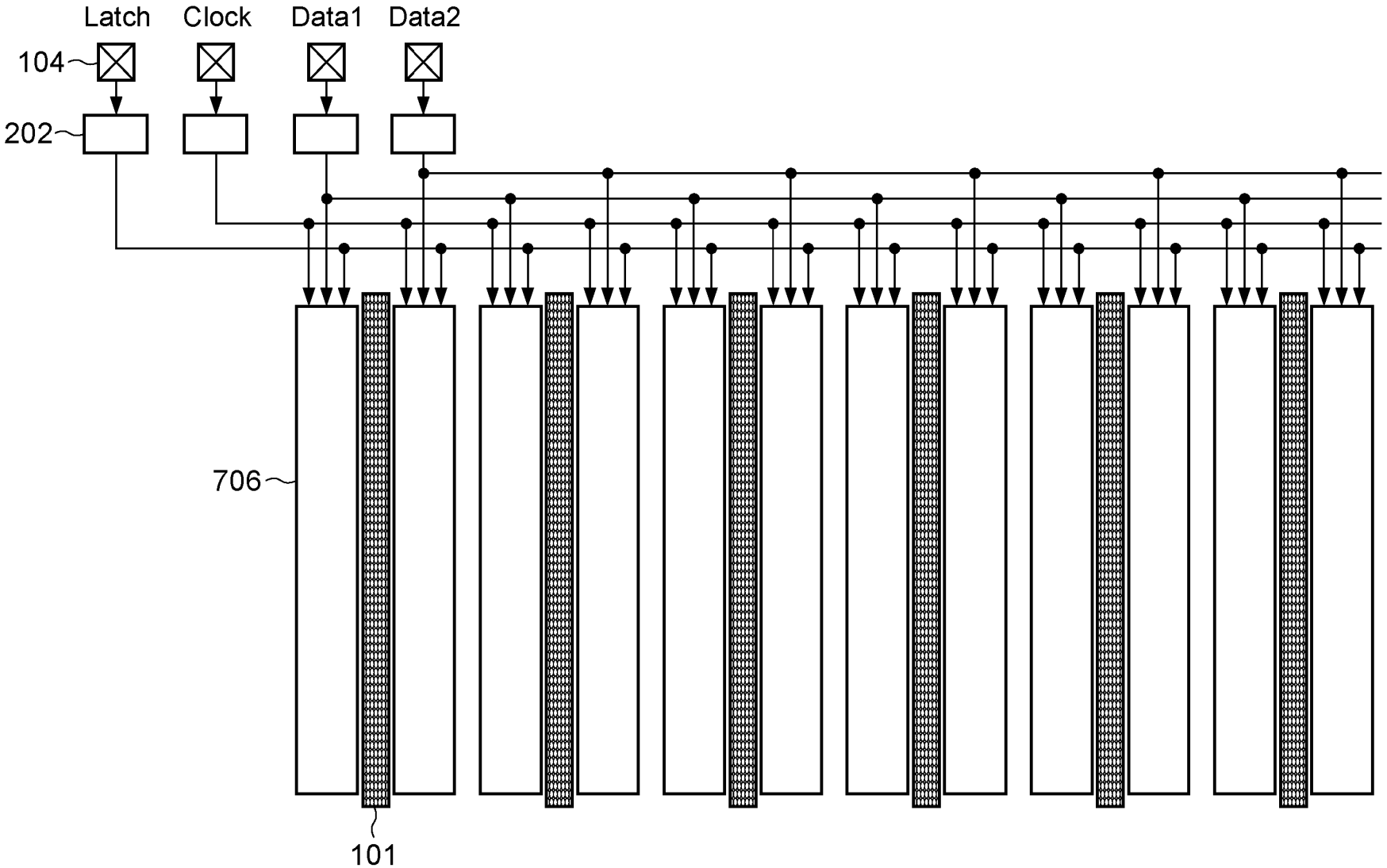
FIG. 10 is a schematic view showing a circuit block and the flow of the electrical signals.

FIG. 10 is a schematic view of a circuit block and the flow of the electrical signals for illustrating a second embodiment of the present invention.

The amount of data for 12 arrays is inputted from one data terminal in the first embodiment; whereas, according to the second embodiment, the data amount is divided into the left array data (Data 1) and the right array data (Data 2) sandwiching ink supply ports therebetween. According to the first embodiment, it is necessary to transmit the data amount for 12 arrays by repeating the data transmitting operation twelve times according to the timing chart of the drawing; whereas, according to the second embodiment, the number of repetitions is six because of the two-line data terminals. Although the number of data signal lines becomes two, the data can be transmitted at a lower speed in comparison with the case of one data signal line.

Third Embodiment

Figure 11:
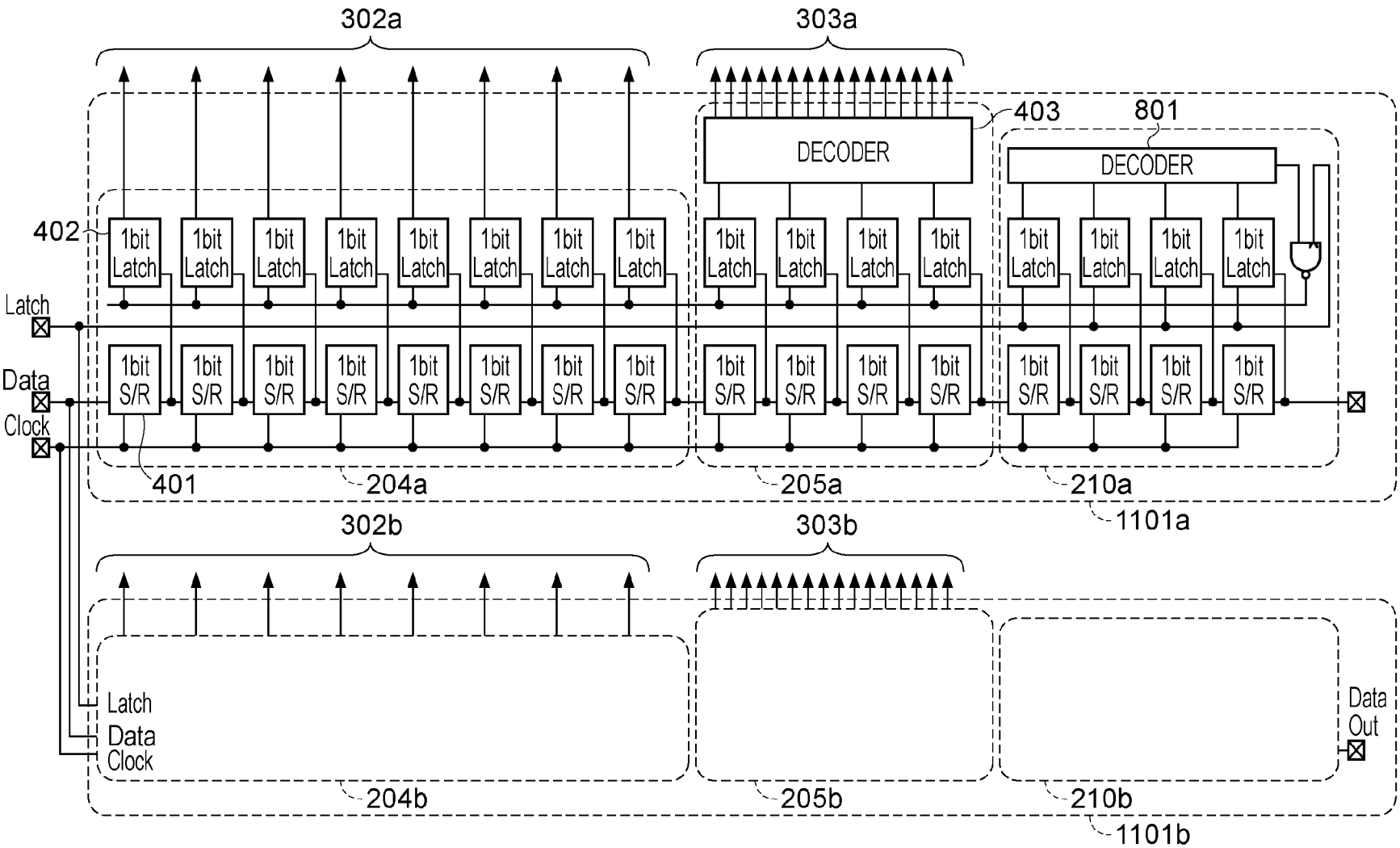
FIG. 11 is a circuit diagram showing the electrical connecting relationship between the shift register corresponding to an arbitrary one array and the decoder.

FIG. 11 is a circuit block diagram showing the electrical connecting relationship between the shift register corresponding to an arbitrary one array and the decoder.

According to a third embodiment, two kinds of the recording element ejecting liquid droplets with two sizes are mixed in one nozzle array.

In each circuit diagram, suffix "a" denotes the circuit for a large liquid droplet and suffix "b" denotes the circuit for a small liquid droplet.

The recording elements are arranged to alternately eject a large liquid droplet and a small liquid droplet. A large liquid-droplet circuit 1101*a* for driving a large liquid droplet and a small liquid-droplet circuit 1101*b* for driving a small liquid droplet are arranged to correspond to one recording element array.

The internal configurations of the large liquid-droplet circuit 1101*a* and the small liquid-droplet circuit 1101*b* are the same; however, a discrimination circuit 210*a* is different from a discrimination circuit 210*b* in corresponding discrimination information.

To the large liquid-droplet circuit 1101*a* and the small liquid-droplet circuit 1101*b*, the same data, clock, and latch signals are applied, respectively.

To two-line array circuits, the different discrimination circuits 210*a* and 210*b* are allocated, respectively, so that by inputting desired discrimination data thereto, respectively, the time-sharing selection data and the block selection data can be transmitted to the latches corresponding to liquid droplets with different sizes.

The reason of the configuration ejecting liquid droplets with two different sizes is to combine the speed up with the improving in image quality. For achieving the speed up, images need to be formed with a large liquid-droplet and small number of ink ejecting times. On the other hand, for improving the gradation and the fineness, it is necessary to form images with a smaller ink-droplet. For having both these ways, the recording element having nozzles ejecting liquid droplets with different large and small sizes is provided.

This configuration enables the respective data of a large liquid-droplet and a small liquid-droplet to be executed from one input terminal.

In a normal recording mode, according to the embodiment, the respective data of a large liquid-droplet and a small liquid-droplet are transmitted so as to eject ink from the respective nozzles, simultaneously or independently.

In a high-speed recording mode, the image recording is achieved in a short period of time by using only large liquid-droplets or by using them very often.

In a high-image quality recording mode, small liquid-droplets are only used or more frequently used so as to improve the gradation and the fineness.

The features of the embodiment include efficient transmission of required data.

In the high-speed recording mode using only large liquid-droplets, the data of the large liquid-droplets has only to be transmitted. In the high-image quality recording mode, the data of the large liquid-droplets and/or the small liquid-droplets have only to be inputted corresponding to the image forming.

By the configuration according to the embodiment, while increase in the number of pads being suppressed, the data corresponding to an arbitrary size of the liquid-droplet can be efficiently transmitted.

Other Embodiments

Figure 12:
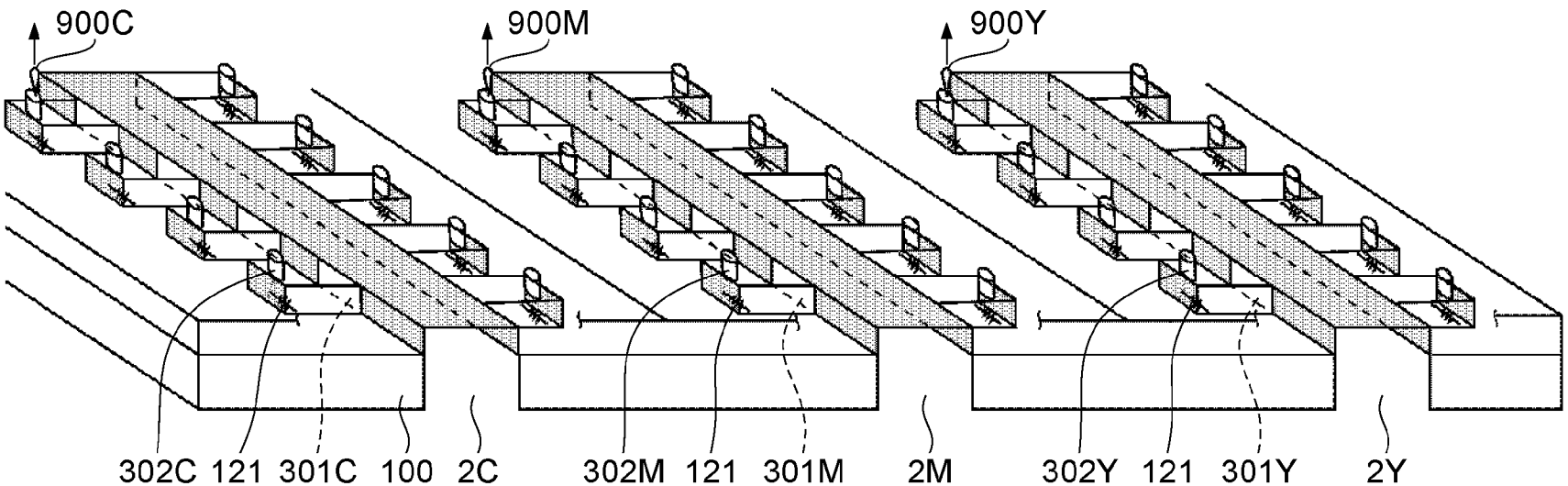
FIG. 12 is a perspective view showing the spatial structure of a recording head IJHC ejecting three-color ink.

The schematic configuration of a recording head according to an embodiment of the present invention will be described below with reference to FIG. 12. FIG. 12 is a perspective view showing the spatial structure of a recording head ejecting three-color ink.

The recording head includes ink supply ports 2C, 2M, and 2Y for ejecting cyan (C), magenta (M), and yellow (Y) inks, respectively.

Ink flow paths 301C, 301M, and 301Y are arranged to correspond to electrothermal transducers (heaters) 121, and C ink, M ink, and Y ink are led to the electrothermal transducers (heaters) 121 arranged on a device substrate through these ink flow paths, respectively. Thus, upon driving the electrothermal transducers (heaters) 121, inks are on the boil, ink droplets 900C, 900M, and 900Y are ejected due to generated bubbles from nozzles 302C, 302M, and 302Y.

In FIG. 12, the device substrate includes the electrothermal transducers, elements, and the above-mentioned drive circuits and pads formed thereon.

In a thermal inkjet head, the electrothermal transducer (heater), the nozzle, and the flow path are summarized as a recording element.

FIG. 12 shows the spatial structure of a color-type recording head IJHC; a recording head IJHK ejecting black ink also has a similar structure. However, its scale is one-third of that shown in FIG. 3. That is, when the ink supply port is one and the number of recording elements is the same, the scale of the device substrate is reduced to about one-third.

Then, the schematic configuration of a recording apparatus having such a recording head mounted thereon will be described.

Description of Inkjet Recording Apparatus

Figure 13:
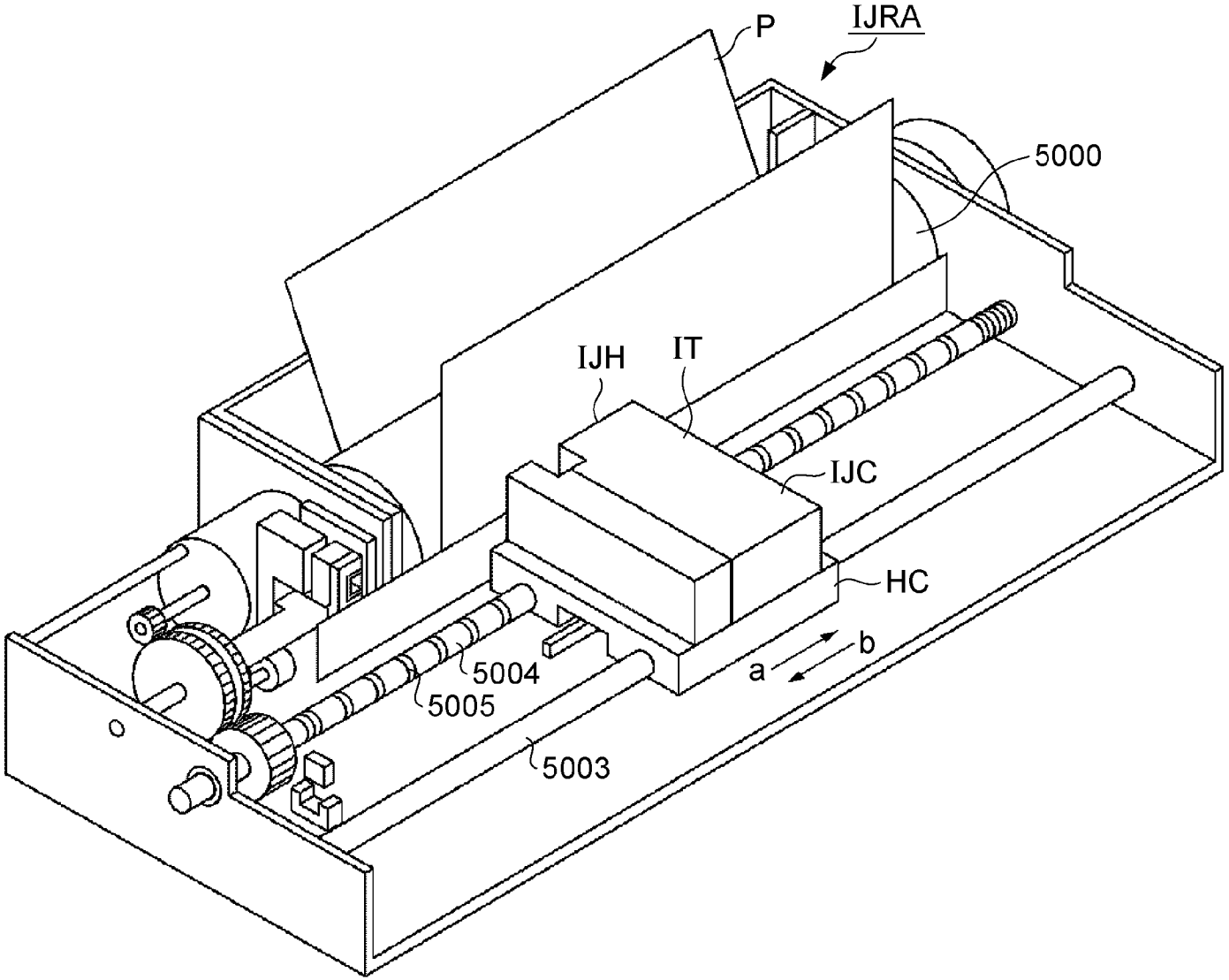
FIG. 13 is a schematic view of a recording apparatus incorporating the invention.

FIG. 13 is a schematic view of an inkjet recording apparatus IJRA according to a typical embodiment of the present invention. A carriage HC includes a pin (not shown) engaged with a spiral groove 5005 of a lead screw 5004, and is reciprocated by the rotation of the lead screw 5004 in arrow directions "a" and "b" while being supported on a guide rail 5003. The carriage HC includes an ink cartridge IJC mounted thereon. The ink cartridge IJC includes an inkjet recording head IJH (referred to as a recording head below) and an ink tank IT containing recording ink.

The ink cartridge IJC has an integral structure of the recording head IJH and the ink tank IT.

A platen 5000 is rotated by a conveying motor (not shown) so as to convey a recording paper P.

Figure 14:
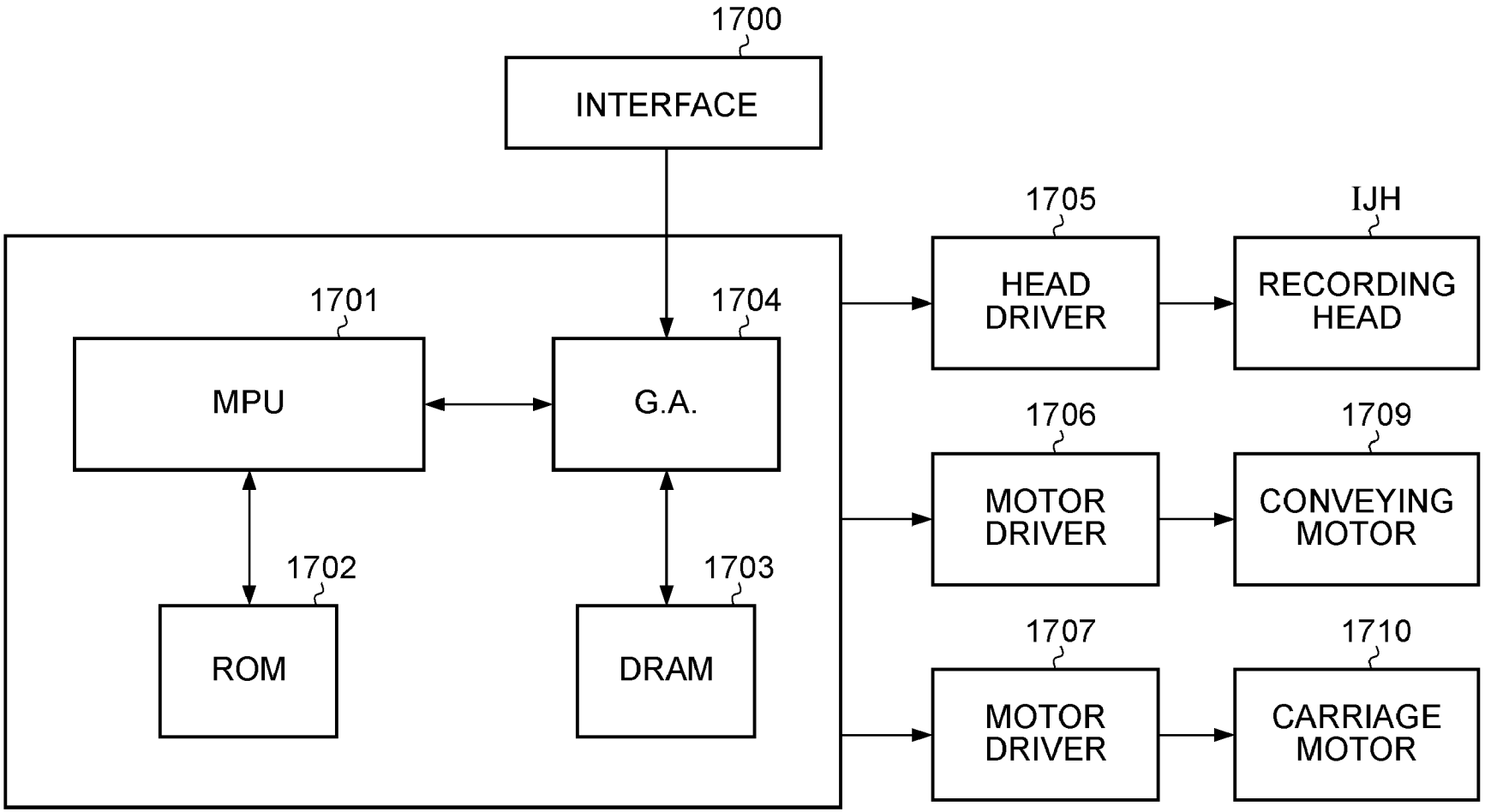
FIG. 14 is a block diagram of the control configuration of the recording apparatus.

FIG. 14 is a block diagram of a control circuit of the recording apparatus.

Referring to FIG. 14, an interface 1700 inputs a recording signal; an ROM 1702 stores a control program to be executed by an MPU 1701; and a DRAM 1703 maintains various data (recording data to be supplied to the recording head). A gate array (GA) 1704 controls the recording data supply to the recording head IJH, and also controls the data transmission between the interface 1700, the MPU 1701, and the RAM 1703.

Furthermore, a conveying motor 1709 (not shown in FIG. 1) conveys the recording paper P; a motor driver 1706 drives the conveying motor 1709; a motor driver 1707 drives a carriage motor 1710; and a head driver 1705 drives the recording head IJH. The head driver 1705 also outputs image data, time-sharing data, and discrimination data to the head.

Upon describing the operation of the control configuration, when a recording signal is inputted in the interface 1700, the recording signal is converted into printing recording data at between the gate array 1704 and the MPU 1701; then, the motor drivers 1706 and 1707 are driven as well as the recording head IJH is driven according to the recording data fed to the carriage HC so as to record images on the recording paper P.

According to the embodiments described above, the inkjet recording head having the electrothermal transducers (heaters) as discharge energy generating elements constituting the recording element has been exemplified; however, an inkjet recording head having piezoelectric elements as discharge energy generating elements and a thermal head used for a sublimation system may also incorporate the invention.

In the inkjet recording head having the ink supply ports, since the drive circuit needs to be provided for the heater array in units of array because the circuit configuration is divided with the ink supply ports, the effect of the configuration according to the present invention is increased.

According to the embodiments of the present invention described above, by providing a circuit discriminating data in the drive circuit, the data can be discriminated that it is transmitted for which group.

Thereby, even when the circuit arrangement is limited and it is difficult to use the circuit in common as in the inkjet recording head, for example, the circuit can be used in common.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-174139 filed Jun. 23, 2006, which is hereby incorporated by reference herein in its entirety.

What is claimed is:

1. A recording head comprising:

a plurality of element arrays, each element array including a plurality of recording elements;

a plurality of array circuits, each array circuit corresponding to a respective element array;

an input terminal configured to input data, the data including image data and discrimination data;

a wiring configured to commonly supply the data inputted in the input terminal to the plurality of array circuits, wherein each array circuit comprises a latch circuit and a decode circuit, the latch circuit configured to latch the discrimination data based on a latch signal and configured to latch the image data based on the latch signal and an output of the decode circuit, the decode circuit configured to decode the latched discrimination data and output a signal based on a result of decoding, wherein the discrimination data is data corresponding to an element array of the plurality of element arrays, and wherein the discrimination data is expressed by a bit number, the bit number being less than the number of array circuits.

2. The recording head according to claim 1, wherein the recording element includes a discharge energy generating element configured to eject ink and a nozzle arranged to correspond to the discharge energy generating element.

3. The recording head according to claim 1, wherein each of the array circuits includes a shift register configured to receive the data via the wiring and the latch circuit configured to receive and hold the data supplied to the shift register.

4. A recording apparatus comprising:

the recording head according to claim 1.

5. A device substrate comprising:

a plurality of element arrays, each element array including a plurality of recording elements;

a plurality of array circuits, each array circuit corresponding to a respective element array;

an input terminal configured to input data for driving the recording elements, the data including image data and discrimination data;

a wiring configured to commonly supply the data inputted in the input terminal to the plurality of array circuits, wherein each array circuit comprises a latch circuit and a decode circuit, the latch circuit configured to latch the discrimination data based on a latch signal and configured to latch the image data based on the latch signal and an output of the decode circuit, the decode circuit configured to decode the latched discrimination data and output a signal based on a result of decoding, wherein the discrimination data is data corresponding to an element array of the plurality of element arrays, and wherein the discrimination data is expressed by a bit number, the bit number being less than the number of array circuits.

* * * * *